United States Patent [19]

Gragson et al.

[11] 4,162,223

[45] Jul. 24, 1979

[54] RESIDUE OF HYDROGENATION PRODUCT OF BRANCHED ALIPHATIC DINITRILES AS LUBRICANT ADDITIVE

[75] Inventors: James T. Gragson; Ralph P. Williams, both of Bartlesville, Okla.

[73] Assignee: Phillips Petroleum Company, Bartlesville, Okla.

[21] Appl. No.: 888,814

[22] Filed: Mar. 21, 1978

[51] Int. Cl.[2] ..... C10M 1/40; C10M 3/34; C10M 5/22; C10M 7/38

[52] U.S. Cl. ..... 252/33.2; 252/33.4; 252/34; 252/50; 252/390; 252/392

[58] Field of Search ..... 252/50, 34.7, 33.2, 252/390, 392, 34, 33.4

[56] References Cited

U.S. PATENT DOCUMENTS

| | | | |
|---|---|---|---|
| 2,862,883 | 12/1958 | Hughes et al. | 252/33.4 |
| 3,114,702 | 12/1963 | Thompson | 252/50 |
| 3,200,106 | 8/1965 | Dickson et al. | 260/97.5 |
| 3,259,578 | 7/1966 | Dickson et al. | 252/34 |
| 3,697,426 | 10/1972 | Lowe | 252/50 |
| 3,720,615 | 3/1973 | Izumi et al. | 252/50 |
| 3,844,958 | 10/1974 | Anderson et al. | 252/50 |
| 3,898,056 | 8/1975 | Honnen | 44/58 |

OTHER PUBLICATIONS

"Manufacture & Application of Lubricating Greases", by Boner, Krieger Pub. Co. Inc., 1971, Huntington, N. Y. pp. 111 & 120.

*Primary Examiner*—Delbert E. Gantz
*Assistant Examiner*—Irving Vaughn

[57] ABSTRACT

The heavy reaction product obtained upon separation, as by distillation, of light reaction products of branched aliphatic dinitriles is useful as rust inhibitor in lubricating oils and greases.

17 Claims, No Drawings

RESIDUE OF HYDROGENATION PRODUCT OF BRANCHED ALIPHATIC DINITRILES AS LUBRICANT ADDITIVE

This invention relates to rust inhibition. In one of its aspects it relates to an additive for a lubricating oil. In another of its aspects it relates to an additive for a grease. More specifically, the invention relates to an additive which will impart rust inhibiting properties to lubricating oil and grease compositions.

In one of its concepts the invention provides an additive useful to impart rust inhibiting properties or qualities to a lubricating oil or to a grease the additive comprising a heavy reaction product obtained from the distillation or other separation of light reaction products from the overall reaction product resulting upon hydrogenation of branched aliphatic dinitriles containing, say, from 7 to 30 carbon atoms per molecule. In another of its concepts the invention provides a composition suitable for use as a lubricant, e.g., a lubricating oil or grease containing at least one polyamine usually contained in a polyamine mixture containing predominately components generally corresponding to the general formula $$H\text{-}[NH\text{—}R']_nNH_2$$

wherein the R's are independently selected from branched alkylene radicals of 7 to 30 carbon atoms and wherein n generally is an integer and has a value of from 2 to about 6. In a further concept of the invention it provides a lubricant composition as herein described containing the product mixture resulting from a reaction of a fatty acid with the mixture of polyamines. In a further concept of the invention the reaction product of the amines mixture and the fatty acid can be a priori prepared and incorporated into the lubricating oil or it can be produced in situ.

Various organic compounds have been proposed and employed commercially as additives for lubricating oil and grease formulations to enhance or modify certain of the properties of the formulations. The lubricating oils and greases employed particularly in internal combustion engines or in bearings or other items or machinery are especially susceptible to environmental conditions which result in the formation of rust on the exposed and lubricated surfaces. Consequently the use of additives in the lubricating formulations to inhibit the rust-forming tendencies is widely known in the art. Frequently these additives are based on complex, costly organic compounds. This invention provides novel lubricating compositions (oils and greases) containing rust-inhibiting additives which additives are based upon or prepared from polyamine mixtures obtained as by-products of known processes for preparing aliphatic diamines useful in polyamides, polyureas, etc. Such polyamine mixtures have been regarded in the past as low-value materials for which appropriate means of disposal have been sought.

The disclosures of the following patents are incorporated herein by reference. U.S. Pat. No. 2,862,883, Dec. 2, 1958, John Hughes and Philip James Garner; U.S. Pat. No. 3,844,958, Oct. 29, 1974, Robert G. Anderson and Louis R. Hennen; U.S. Pat. No. 3,720,615, Mar. 13, 1973, Kaichi Izumi and Takso Watanabe.

It is also an object of this invention to provide a new additive for a lubricating oil. It is also an object of this invention to provide a new additive for a grease which can be used for lubricating purposes. It is a further object of the invention to provide a new lubricating oil composition having rust-resistance properties. A still further object of the invention is to provide a grease composition having rust-resistance properties. A further object of the invention is to provide an automotive engine oil having good rust-resistance properties.

Other aspects, concepts, objects and the several advantages of this invention are apparent from a study of this disclosure and the appended claims.

According to the present invention, rust inhibiting additives are provided which are, usually, a mixture of polyamines obtained as a heavy reaction product from the hydrogenation of branched aliphatic dinitriles containing 7 to 30 carbon atoms per molecule and/or a product mixture from the reaction of such polyamine or mixture with a fatty acid, the said additives being incorporated with a lubricating oil or grease, as further described in more detail herein.

The mixture of polyamines useful in this invention is obtained as the heavy reaction product from the hydrogenation of branched aliphatic dinitriles containing from 7 to 30 carbon atoms per molecule and preferably 9 to 12 carbon atoms per molecule. Thus the polyamine mixtures useful in this invention contain predominantly components generally corresponding to the general formula $H\text{-}[NH\text{—}R']_nNH_2$ wherein the R's are independently selected from branched alkylene radicals of 7 to 30, and preferably 9 to 12, carbon atoms per radical and wherein n generally has the value of from 2 to about 6. Said branched alkylene radicals will contain one or more side chains with each side chain being an alkyl radical of one to about six carbon atoms per alkyl radical.

The above-described branched aliphatic dinitriles from which the polyamine mixture of this invention are prepared can be free from olefinic unsaturation or can contain olefinic unsaturation. Representative examples of olefinically unsaturated branched dinitriles include such compounds as 4-methyl-3-hexenedinitrile, 4-ethyl-3-hexenedinitrile, 5-methyl-4-nonenedinitrile, 5-ethyl-4-decenedinitrile, 7-methyl-6-tridecenedinitrile, 7-methyl-6-pentadecenedinitrile, 12-methyl-12-tetracosenedinitrile, 10-hexyl-9-tetracosenedinitrile, 2,3-dimethyl-3-hexenedinitrile, 2,4,6-trimethyl-3-heptenedinitrile, 4-ethyl-6,7-dimethyl-3-octenedinitrile, 2,4,6-triethyl-3-octenedinitrile, 2-ethyl-4,6-dipropyl-3-octenedinitrile, 2-methyl-4,6,8,10-tetrapropyl-3-dodecenedinitrile, 2,4,7,9,11,13,15-heptaethyl-6-hexadecenedinitrile, 3-methylenehexanedinitrile, 4-methyleneheptanedinitrile, 5-methylenenonanedinitrile, 6-methyleneundecanedinitrile, 7-methylenetridecanedinitrile, 8-methylenepentadecanedinitrile, 12-methylenetetracosanedinitrile, 15-methylenenonacosanedinitrile, 2-methyl-3-methylenepentanedinitrile, 2,4-dimethyl-3-methylenepentanedinitrile, 2-methyl-4-methyleneoctanedinitrile, 2-methyl-7-ethyl-4-methyleneoctanedinitrile, 2,4,8-trimethyl-6-methylenedodecanedinitrile, 2,4,8,10-tetrapropyl-6-methylenedodecanedinitrile, 2,26-dimethyl-14-methyleneheptacosanedinitrile, and mixtures thereof. The saturated analogs of the above olefinically unsaturated branched dinitriles are representative examples of branched aliphatic dinitriles free from olefinic unsaturation.

A presently preferred branched-chain unsaturated aliphatic dinitrile feedstock for employment in the preparation of polyamine mixture for use in this invention is the dinitrile reaction product mixture obtained by the reaction of isobutylene and acrylonitrile. This dinitrile reaction product mixture generally comprises 5-methyl-4-nonenedinitrile, 2,4-dimethyl-4-octenedinitrile, 2,4-dimethyl-3-octenedinitrile, 2,4,6-trimethyl-3-heptenedinitrile, 5-methylenenonanedinitrile, 2-methyl-4-methyleneoctanedinitrile, and 2,6-dimethyl-4-methyleneheptanedinitrile. This preferred unsaturated dinitrile mixture is readily prepared by procedures described in U.S. Pat. Nos. 3,840,583 and 3,985,786.

The hydrogenation of the above-described branched aliphatic dinitriles can be conducted as described in U.S. Pat. Nos. 3,880,928; 3,880,929; 3,896,173; 3,896,174; 3,898,286 and others. Separation of the light reaction products, i.e., saturated aliphatic diamines, from the heavy polyamine mixture is accomplished by conventional means, such as fractional distillation. The polyamine mixture useful in this invention is referred to in the above patents pertaining to hydrogenation as "heavies" or "distillation residue."

Exemplary catalysts for the hydrogenation of the branched aliphatic dinitriles include platinum-, palladium-, ruthenium-, rhodium-, cobalt-, and nickel-containing compounds, alone or combinations thereof or in combination with various known promoters. Any of the well-known catalyst supports, such as alumina, can be employed. The hydrogenation can be conducted in a single stage or in a two-stage reaction, in which, if desired, the olefinic unsaturation, should any be present, is hydrogenated under different conditions than the nitrile groups. If desired, the hydrogenation of a portion or stage thereof can be conducted in the presence of a secondary amine suppressant, such as ammonia or tertiary amine.

The hydrogenation of the branched aliphatic dinitriles can be carried out in the temperature range of about 30° C. to about 250° C., preferably in the range of about 70° C. to 200° C. and in the pressure range of from about 3.5 megapascals to about 35 megapascals and preferably within the range of about 7 megapascals to about 20 megapascals.

The diluent utilized in the hydrogenation process, if desired, is generally selected from the group consisting of alcohols, ethers, hydrocarbons, and mixtures thereof which will adequately dissolve or suspend the branched aliphatic dinitriles to facilitate hydrogenation. Suitable diluents include methanol, ethanol, 2-propanol, 2-methyl-2-propanol, 2-butanol, 1-hexanol, diethyl ether, 1,4-dioxane, tetrahydrofuran, n-hexane, n-heptane, 2,2,4-trimethylpentane, cyclohexane, and mixtures thereof. To facilitate hydrogenation and handling of the reaction mixtures, the diluents will generally be employed in amounts ranging from 2/1–20/1 and preferably 5/1–12/1 parts by weight of diluent per part by weight of branched aliphatic dinitriles.

The heavy polyamine mixture employed in the present invention is separated from the hydrogenation reaction mixture by conventional means, such as filtration to remove catalyst particles, followed by evaporation of volatile materials thus leaving a heavy mixture of polyamine compounds.

The fatty acids employed for reaction with the abovedescribed polyamine mixture, where such should be desired, are selected from the linear or branched saturated carboxylic acids containing from 4 to about 30 carbon atoms per molecule. Preferred fatty acids are linear saturated carboxylic acids containing from 12 to 20 carbon atoms per molecule.

Examples of useful fatty acids include butyric, valeric, isovaleric, caproic, caprylic, capric, lauric, myristic, pentadecanoic, palmitic, heptadecanoic, stearic, arachidic, behenic, cerotic, melissic, etc. acids and the like and mixtures thereof.

In the preparation of the reaction product (presently believed to be a mixture of salts) of the fatty acid and the polyamine mixture the proportions of the reactants will generally be in the range of from about 10/1 to about 0.1/1 equivalents of fatty acid per equivalent of amine in the polyamine mixture. It is generally preferable to employ the reactants in the range of 1.1/1 to 0.5/1 equivalents of fatty acid per amine equivalent.

The reaction product is readily prepared by simple admixing with stirring of the reactants, preferably in an appropriate diluent, such as benzene, toluene, etc., at any desirable temperature, such as 0° to 100° C., and preferably 20° to 40° C. The reaction product can also be produced in situ in the oil or grease. It appears that a small excess of amine, based on equivalents, may be desirable for use in lubricating oil.

In the preparation of the lubricating oil compositions containing the instant rust-inhibiting additives, various mineral oils are employed. Generally, these are of petroleum origin and are complex mixtures of many hydrocarbon compounds. Preferably, the mineral oils are refined products such as are obtained by wellknown refining processes, such as by hydrogenation, polymerization, dewaxing, etc. Frequently, the oils have a Saybolt viscosity at 100° F. in the range from about 60 to 5,000 and a Saybolt viscosity at 210° F. of about 30 to 250. The oils can be of the paraffinic, naphthenic, or aromatic types, as well as mixtures of one or more types. Many suitable lubricating compositions are available as commercial products such as those used as motor oils, gear oils, automatic transmission oils, and the like. Generally, it is now preferred to add the polyamine mixture to a lubricating oil already containing a detergent such as a calcium petroleum sulfonate and an oxidation inhibitor. While the said mixture acts well in such an oil, it does not appear that it will do so in an unmodified lubricating oil base stock. However, the polyamine mixture - fatty acid reaction product will give good results in such an oil. A large preponderance of lubricating oils used in automotive engines already contain additives, e.g., detergent and oxidation inhibitor.

Other agents well known for use in lubricating oil formulations can be present in the lubricant composition such as dyes, pour point depressants, heat thickened fatty oils, sulfurized fatty oils, sludge dispersers, foam suppressants, thickeners, viscosity index improvers, resins, rubber, and the like.

Generally, any conventional and commercially available grease can be used in accordance with this invention. The grease employed can have been thickened in any known manner such as by the use of soaps and/or by dissolving polymers in the oil at temperatures of at least 245° F. and the like.

Suitable greases include substantially any grade of flowable grease as defined by the National Lubricating Grease Institute (NLGI). For example, NLGI grade greases from 000 to 6 can be employed in this invention. Also, greases having ASTM D 217-68 penetration at 60 strokes in the range of 85 to 475 can be employed.

The lubricating oil bases which can be employed to make grease of this invention can be mineral, vegetable, or animal in nature, preferably lubricant bases having at least a major amount of mineral origin. Such oils include refined oils having a viscosity of from about 35 to about 240 SUS at 210° F. White mineral oil as well as other specialty oils can be used and are among the preferred oils.

Thickeners for the oils can be employed in amounts up to 20 weight percent of the oil. Various soaps normally used to thicken greases can be used, and they include metal salts of higher molecular weight acids, for example, acids of 10 to 30 carbon atoms, and preferably 16 to 24 carbon atoms, either synthetic or of animal or vegetable origin. Other carboxylic acids useful for making soaps of metal salts include those derived from tallows, hydrogenated fish oil, castor oil, wool grease, and rosin. Generally, the alkali metal or alkaline earth metal or aluminum or lead salts of acids such as lauric, palmitic, oleic, stearic, and the like are used. One of the preferred soaps is the lithium soap of 12-hydroxystearic acid. While soaps of a general nature can be used in the greases of this invention, it should be understood that the invention includes use with soapless greases formed essentially from polymers and oil alone, with or without small amounts of known grease additives such as fillers and the like. Thus, polymers such as polyethylene and polypropylene can be employed as thickeners, together, alone or in conjunction with other thickeners such as soap.

Other materials normally used in greases can also be employed in the greases applicable to this invention. For example, additives such as antioxidants, fillers, pigments, perfumes, and the like can be employed. Some examples of such materials include mica, asbestos, powdered lead, powdered zinc, talc, alumina, titanium dioxide, molybdenum disulfide, Bentone TM, carbon black, nitrobenzene, and the like. Generally, the amount of these modifiers is less than about 10 percent of the total weight of the grease.

The above-described polyamine mixture and polyamine/fatty acid reaction product are employed in the lubricating oil or grease compositions in amounts ranging from 0.05 to 5 weight percent based on the total composition and preferably 0.1 to 2 weight percent.

The additives of the invention do not appear to affect adversely the usual properties of the lubricating oil compositions or greases to which they are added.

While either the polyamine mixture or the polyamine/fatty acid reaction product can be employed with either the lubricating oil formulation or the grease formulation of this invention, it is preferable to use the polyamine mixture with the grease formulation and the polyamine/fatty acid reaction product with the lubricating oil formulation. This preference is based on the observation hereinafter presented that better results are obtained by so doing but the reasons are not well-understood.

EXAMPLE I

The polyamine mixture described hereinafter as being employed either alone or as a reaction product with stearic acid in grease or lubricating oils formulations was prepared in a sequence of steps which involved the reaction of isobutylene and acrylonitrile to produce a mixture of olefinically unsaturated dinitriles which were subsequently recovered by fractional distillation, hydrogenation of the dinitrile mixture and filtration and subsequent distillation of the reaction product to separate volatile diamine products from the desired heavy polyamine mixture.

A solution of acrylonitrile (one part by weight), isobutylene (2 parts by weight), a monoadduct reaction product of isobutylene and acrylonitrile (as described in U.S. Pat. No. 3,985,786 and containing predominantly 5-methyl-5-hexenenitrile and 2,4-dimethyl-4-pentenenitrile; 2 parts by weight) and water (0.25 part by weight) was continuously added to a 19 l reactor at 270°–280° C. and 17 megapascals. Residence time in the reactor of 0.6 to 0.7 hours resulted in about 50 percent of the acrylonitrile being converted to products.

Effluent from the above-described reactor was fractionally distilled to separate unreacted starting materials for recycle and products, including a diadduct reaction product mixture (as described in U.S. Pat. No. 3,985,786 and containing predominantly 5-methylene-1,9-nonanedinitrile and 5-methyl-4-nonenedinitrile and minor amounts of other isomers; diadduct product mixture represents about 85 percent by weight of total products) and a heavy distillation residue (about 15 percent by weight of total products).

The above-described diadduct product mixture was hydrogenated in a 2-stage continuous hydrogenation system. Two tubular reactors (the first 5.1 cm diameter×2.45 m length and the second 5.1 cm diameter×3.05 m length) were connected in series. The first reactor contained 4.7 kg of 0.5 weight percent palladium on alumina, while the second reactor contained 5.0 kg of 0.5 weight percent ruthenium on alumina. A solution of the diadduct product mixture (0.454 kg/hr) and tert-butyl alcohol (3.68 kg/hr) was pumped through the reactors along with one scfm (standard cubic feet per minute) of hydrogen. Ammonia (0.68 kg/hr) was added to the stream between the first and second reactors. The reactors were maintained at 11 megapascals and 100° C. for the first reactor and 10.3 megapascals and 121° C. for the second reactor.

The resultant reaction mixture was fractionally distilled to remove solvent, volatile product (mixture containing predominantly 5-methyl-1,9-nonanediamine and other isomers and other byproducts in minor amounts). The remaining heavy distillation residue was a viscous, dark-colored liquid mixture of polyamines (10.4 percent by weight based on total products).

The resulting heavy polyamine mixture was found to have an average molecular weight of 393 (by vapor pressure osmometry) and an average of 3.2 equivalents of nitrogen per mole (by titration with 0.1 N HCl). Analysis of the polyamine mixture by infrared and nuclear magnetic resonance spectroscopy revealed that the mixture contained predominantly compounds of general formula

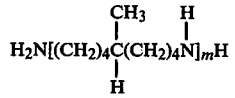

$$H_2N[(CH_2)_4\overset{\overset{CH_3}{|}}{\underset{\underset{H}{|}}{C}}(CH_2)_4\overset{\overset{H}{|}}{N}]_mH$$

and minor amounts of other isomers. Of the total polyamine mixture, approximately 70 percent by weight corresponded to the above formula with m=2. The remaining approximately 30 weight percent corresponded to the above formula with m=3 and 4 and minor amounts of other isomers and higher oligomers.

Reaction products of the above-described polyamine mixture and stearic acid were prepared by slowly adding a solution of 61.0 gm polyamine mixture in 100 ml benzene to a stirred solution of 142.2 gm stearic acid in 300 ml benzene at room temperature. After one hour additional stirring at room temperature, the benzene was removed under vacuum to give the desired reaction product. An additional run was conducted as described with the only exception being the use of 64.05 gm of polyamine mixture.

The above-described polyamine mixture and polyamine/stearic acid reaction products were employed as rust inhibitors in lubricating oil formulations and grease formulations the evaluations of which with appropriate control runs are recorded in Tables I and II, respectively.

TABLE I

| | Lubricating Oil Formulations | | | | |
|---|---|---|---|---|---|
| Run No. | Oil[1] | PA | PA/SA[3] | CA[4] | Rust[5] |
| 1 | T-A[6] | 0 | 0 | 0 | medium |
| 2 | T-A | 1% | 0 | 0 | none, slight stain |
| 3 | T-A | 0 | 1%[7] | 0 | very light |
| 4 | T-A | 0 | 0.25%[8] | 0 | light after 19 hrs. |
| 5 | T-A | 0 | 1%[8] | 0 | none |
| 6 | T-A | 0 | 0 | 1% | none |
| 7 | KC-20[9] | 0 | 1%[8] | 0 | none |
| 8 | KC-20 | 1% | 0 | 0 | heavy |

[1]Base lubricating oil to which additives were added.
[2]Polyamine mixture described above, percent by weight of total formulation.
[3]Polyamine/stearic acid reaction product described above, percent by weight of total formulation.
[4]Commercial additive-Lubrizol 5221 from Lubrizol Corporation.
[5]Modified ASTM D-665. Modification consists of use of 1% acetic acid solution in place of distilled water.
[6]A commercial SAE 10W-40 motor oil formulation containing calcium petroleum sulfonate, oxidation inhibitor, viscosity index improver, and ashless dispersant.
[7]Reaction product made using stoichiometric amounts of stearic acid and amine in the polyamine mixture.
[8]Reaction product made using a 5% excess of amine in the polyamine mixture over stearic acid based on equivalents.
[9]A 200 neutral petroleum oil without additional additives.

TABLE II

| | Grease Formulations[1] | | |
|---|---|---|---|
| Run No. | PA[2] | PA/SA[3] | Rust[4] |
| 9 | 1% | 0 | 1,1 |
| 10 | 0.5% | 0 | 1,1 |
| 11 | 0.25% | 0 | 1,1,1,2 |
| 12 | 0 | 0 | 3 |
| 13 | 0 | 0.5%[5] | 3,3 |
| 14 | 0 | 0.5%[6] | 3,3 |

[1]Base grease (NLGI #2) is thickened with lithium 12-hydroxystearate. Contains no rust inhibitor or oxidation inhibitor.
[2]See footnote 2 of Table I.
[3]See footnote 3 of Table I.
[4]ASTM D-1743. Ratings are 1 (no rust)-pass, 2 (1 or 2 rust spots)-repeat, 3 (more than 2 rust spots)-fail. Multiple values given in Table II are results of duplicate determinations.
[5]See footnote 7 of Table I.
[6]See footnote 8 of Table I.

The data in Table I show that in lubricating oil formulations the mixture of polyamines (run 2) and the polyamine/stearic acid reaction product significantly reduced the rust-forming tendencies compared to control 1 without the inventive additive. The reasons for the apparently anomalous result of run 8 are not well understood. It is possible that in order to inhibit rust formation in lubricating oil formulations, the polyamine mixture may also need at least one of the ingredients present in the commercial SAE 10W-40 formulation of run 2.

The data in Table II show that the inventive mixture of polyamines imparts considerable rust resistance to grease formulations (runs 9–11) compared to control run 12 which did not contain the inventive mixture of polyamines. A comparison of runs 13 and 14 with runs 3–5 and 7 shows that the inventive polyamine/stearic acid reaction product is much more effective as a rust inhibitor in lubricating oil formulations than in grease formulations.

Thus it is seen from Table I and II that the polyamine mixture is effective in inhibiting rust formation of metal surfaces in contact with greases and lubricating oil formulations containing the inventive additives, though apparently a base oil without other conventional lubricating oil additives is not benefitted by the polyamine mixture. Likewise it is seen that the inventive polyamine/stearic acid reaction product is an effective rust inhibitor for lubricating oil formulations, as well as base oil without other additives, but, apparently, is not effective in the grease formulation tested.

Judging by the data given herein it appears that the additives of the invention will have an improving effect as a component of a motor fuel.

Reasonable variation and modification are possible within the scope of the foregoing disclosure and the appended claims to the invention the essence of which is that the heavy reaction product from the hydrogenation of branched aliphatic dinitriles, as described, has been found to be a mixture of polyamines useful to impart rust-resistence qualities to a lubricating oil; that is reaction product with a fatty acid, also as described, is also useful to impart such properties to said oil; and that said heavy reaction product will impart rust-resistence properties to a lubricating grease.

We claim:

1. A lubricating composition containing a heavy reaction product obtained from the hydrogenation of branched aliphatic dinitriles containing from 7 to 30 carbon atoms per molecule said product essentially containing a mixture of aliphatic diamines and polyamines.

2. A composition according to claim 1 wherein the dinitriles contain 9 to 12 carbon atoms per molecule.

3. A composition according to claim 1 wherein there is in the composition a lubricating oil and at least one of said heavy reaction product and a reaction product of it with a fatty acid.

4. A composition according to claim 1 wherein there is in the composition a lubricating grease and said heavy reaction product.

5. A composition according to claim 1 wherein said heavy reaction product is recovered as a residue in the separation of light reaction products, essentially consisting of saturated aliphatic diamines, from the hydrogenation of branched aliphatic dinitriles in the presence of a hydrogenation catalyst.

6. A composition according to claim 2 wherein said heavy reaction product is recovered as a residue in the separation of light reaction products, essentially consisting of saturated aliphatic diamines, from the hydrogenation of branched aliphatic dinitriles in the presence of a hydrogenation catalyst.

7. A composition according to claim 3 wherein said heavy reaction product is recovered as a residue in the separation of light reaction products, essentially consisting of saturated aliphatic diamines, from the hydrogenation of branched aliphatic dinitriles in the presence of a hydrogenation catalyst.

8. A composition according to claim 4 wherein said heavy reaction product is recovered as a residue in the separation of light reaction products, essentially consisting of saturated aliphatic diamines, from the hydrogenation of branched aliphatic dinitriles in the presence of a hydrogenation catalyst.

9. A composition according to claim 1 wherein said heavy reaction product is a mixture containing polyamines corresponding to the formula $H\text{-}\underline{E}NH\text{—}R\text{-}'\underline{\exists}_n NH_2$ wherein the R's are independently selected from branched alkylene radicals of 7 to 30 carbon atoms and where n has a value of from 2 to about 6.

10. A composition according to claim 2 wherein said heavy reaction product is a mixture containing polyamines corresponding to the formula $H\text{-}\underline{E}NH\text{—}R\text{-}'\underline{\exists}_n NH_2$ wherein the R's are independently selected from branched alkylene radicals of 7 to 30 carbon atoms and where n has a value of from 2 to about 6.

11. A composition according to claim 3 wherein said heavy reaction product is a mixture containing polyamines corresponding to the formula $H\text{-}\underline{E}NH\text{—}R\text{-}'\underline{\exists}_n NH_2$ wherein the R's are independently selected from branched alkylene radicals of 7 to 30 carbon atoms and where n has a value of from 2 to about 6.

12. A composition according to claim 4 wherein said heavy reaction product is a mixture containing polyamines corresponding to the formula $H\text{-}\underline{E}NH\text{—}R\text{-}'\underline{\exists}_n NH_2$ wherein the R's are independently selected from branched alkylene radicals of 7 to 30 carbon atoms and where n has a value of from 2 to about 6.

13. A composition according to claim 6 wherein there is in the composition a lubricating oil containing at least one of a detergent of the nature of a calcium petroleum sulfonate and an oxidation inhibitor.

14. A composition according to claim 7 wherein there is in the composition a lubricating oil containing at least one of a detergent of the nature of a calcium petroleum sulfonate and an oxidation inhibitor.

15. A composition according to claim 9 wherein there is in the composition a lubricating oil containing at least one of a detergent of the nature of a calcium petroleum sulfonate and an oxidation inhibitor.

16. A composition according to claim 10 wherein there is in the composition a lubricating oil containing at least one of a detergent of the nature of a calcium petroleum sulfonate and an oxidation inhibitor.

17. A composition according to claim 11 wherein there is in the composition a lubricating oil containing at least one of a detergent of the nature of a calcium petroleum sulfonate and an oxidation inhibitor.

* * * * *